US006730050B2

(12) United States Patent
Huang

(10) Patent No.: US 6,730,050 B2
(45) Date of Patent: May 4, 2004

(54) HANDHELD MASSAGER WITH CIRCULATORY CONTACT MOTION

(75) Inventor: Chien-Ming Huang, Taipei (TW)

(73) Assignee: HoMedics, Inc., Commerce Township, MI (US)

( * ) Notice: Subject to any disclaimer, the term of this patent is extended or adjusted under 35 U.S.C. 154(b) by 0 days.

(21) Appl. No.: 09/874,618

(22) Filed: Jun. 5, 2001

(65) Prior Publication Data

US 2002/0183668 A1 Dec. 5, 2002

(51) Int. Cl.[7] ..... A61H 7/00

(52) U.S. Cl. ..... 601/93; 601/94; 601/103; 601/112; 601/134; 601/136

(58) Field of Search ..... 601/67, 69, 70, 601/72, 84, 97, 101–104, 107–109, 111, 89, 93, 95, 133–135, 112

(56) References Cited

U.S. PATENT DOCUMENTS 1,577,924 A * 3/1926 Matchett et al. ..... 601/103
1,998,522 A * 4/1935 Pyles ..... 601/101
2,512,536 A * 6/1950 Zadek ..... 601/93
2,639,707 A * 5/1953 Brown ..... 601/95
3,536,064 A * 10/1970 Kuroda ..... 601/93
4,920,957 A * 5/1990 Sutherland ..... 601/101
5,065,743 A * 11/1991 Sutherland ..... 601/101
5,716,332 A * 2/1998 Noble ..... 601/107
5,935,089 A * 8/1999 Shimizu ..... 601/111
6,149,611 A * 11/2000 Chen ..... 601/22
6,165,145 A * 12/2000 Noble ..... 601/103
6,183,429 B1 * 2/2001 Dervieux ..... 601/87
6,432,072 B1 * 8/2002 Harris et al. ..... 601/103
2001/0027280 A1 * 10/2001 Huang ..... 601/108

* cited by examiner

*Primary Examiner*—Nicholas D. Lucchesi
*Assistant Examiner*—Quang D. Thanh
(74) *Attorney, Agent, or Firm*—Brooks Kushman P.C.

(57) ABSTRACT

A massager has a motor with a motor shaft extending out from opposite ends of the motor, a pair of linkages each rotatably and eccentrically connected to opposite ends of the motor shaft, a bridge securely attached to the linkages with a pair of flexible arms and a pair of massage nodes securely mounted on the bridge. The bridge is pivotal relative to the housing so that the movement of the linkages caused by the rotation of the motor shaft drives the massage nodes on opposite sides of the bridge to pivotally reciprocate laterally, providing a rubbing massage effect.

15 Claims, 5 Drawing Sheets

HANDHELD MASSAGER WITH CIRCULATORY CONTACT MOTION

BACKGROUND OF THE INVENTION

1. Field of the Invention

The present invention relates to a massager, and more particularly to a massager with a bridge pivotally mounted on the massager and a pair of massage nodes detachably connected to opposite ends of the bridge so as to create a rubbing and massage effect to the user when the bridge is in operation.

2. Description of Related Art

With reference to FIGS. 7 and 8, a conventional massager (50) comprises a motor (51), a pair of linkages (52) and a pair of massage balls (53). The linkages (52) are eccentrically connected to opposite ends of the motor shaft (not shown). Each of the massage balls (53) is securely engaged with one of the linkages (52). Because the linkages (52) are eccentrically engaged with the motor shaft, the motor (51) will thus drive and move the linkages (52). That is, the rotational movement of the motor shaft will be transformed into reciprocating movement of the linkage (52). Accordingly, the balls (53) securely mounted on the linkages (52) will move up and down. When the massager is against the user's skin, the up and down movement of the balls (53) generates a massage effect to the user.

However, the massaging effect generated by the monotonous up and down movement of the balls (53) can only be applied to a single limited area. When the user wants to apply the massager to a nearby area, the user will have to move the massager of this kind to the designated nearby area. Therefore, not only is the massage effect not as good as expected, but using this massager is troublesome.

To overcome the shortcomings, the present invention tends to provide an improved massager to mitigate and obviate the aforementioned problems.

SUMMARY OF THE INVENTION

The primary objective of the present invention is to provide a massager that generates a lateral massage effect. To accomplish this objective the massager in accordance with the present invention has a motor, a bridge, a pair of massage nodes and a pair of linkages. The bridge is pivotally engaged with the massager. The massage nodes are detachably connected to the bridge. The motor has a shaft with a linkage securely and eccentrically connected to each end of the motor shaft. The eccentric connection of the linkages to the ends of the shaft will transform the rotation movement of the motor shaft into linear movement of the linkages. The linear movement of the linkages will be transmitted to the bridge and cause the bridge to pivotally reciprocate. Because the massage nodes are securely attached to the bridge, the massage modes also reciprocate laterally.

Other objects, advantages and novel features of the invention will become more apparent from the following detailed description when taken in conjunction with the accompanying drawings.

DETAILED DESCRIPTION OF PREFERRED EMBODIMENT

Figure 1:
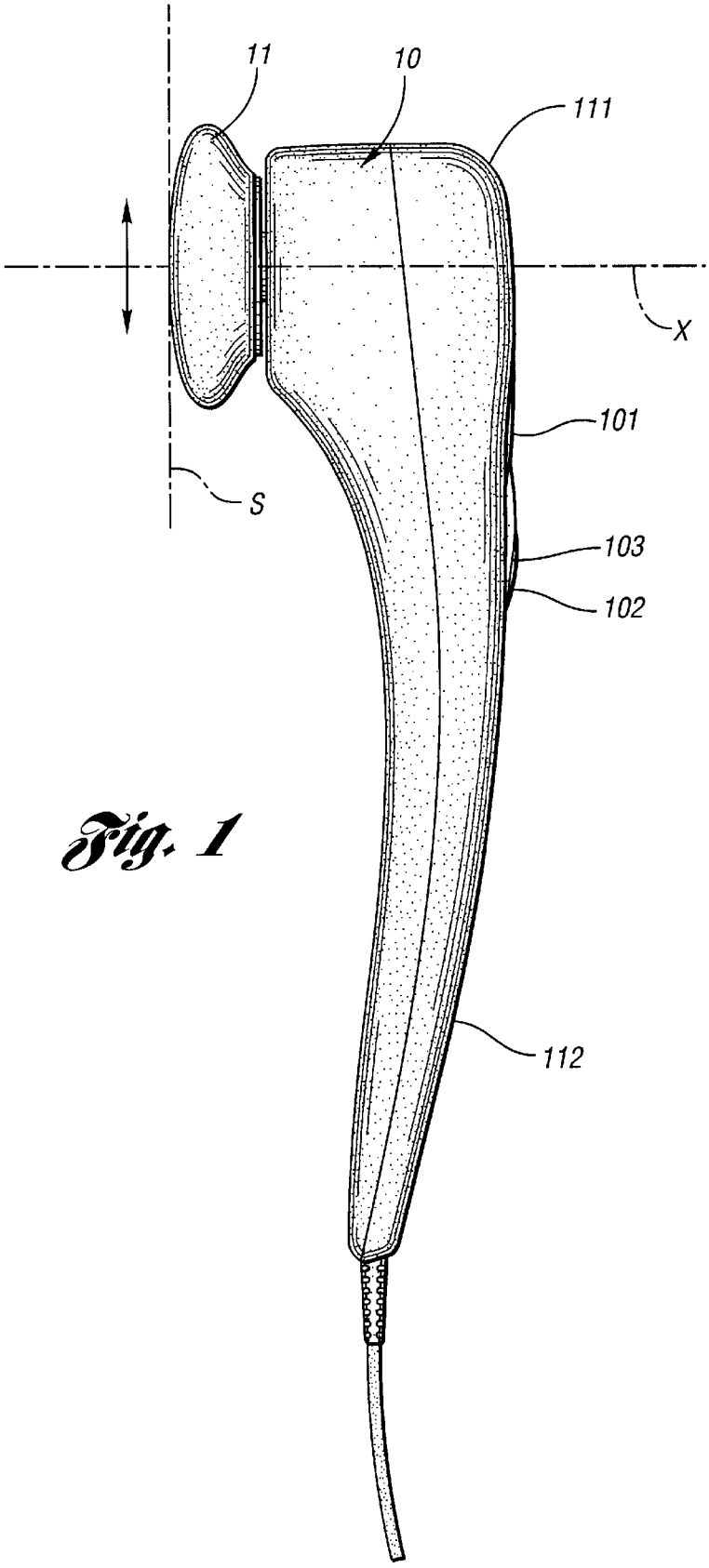
FIG. 1 is a side plan view of the massager in accordance with the present invention.

With reference to FIGS. 1, 2, 3 and 4, the massager in accordance with the present invention has a housing (10) having head portion (111), an elongated laterally extending handle (112), a pair of massage nodes (111), a bridge (14), a motor (12) and a pair of linkages (13).

The motor (12) is securely mounted in the head portion (111) of housing (10) with a motor bracket (not numbered) and has a motor shaft (121) extending from each end of the motor (12). Each of the linkages (13) is eccentrically and rotatably connected to an opposite end of the motor shaft (121). The eccentric connection points on the ends of the shaft (121) are diametrically opposite to each other. The bridge (14) is pivotally attached to the motor (12) retainer bracket by a pivotal connector (141) and is securely attached to both linkages (13) with corresponding flexible connecting arms (131).

Figure 3:
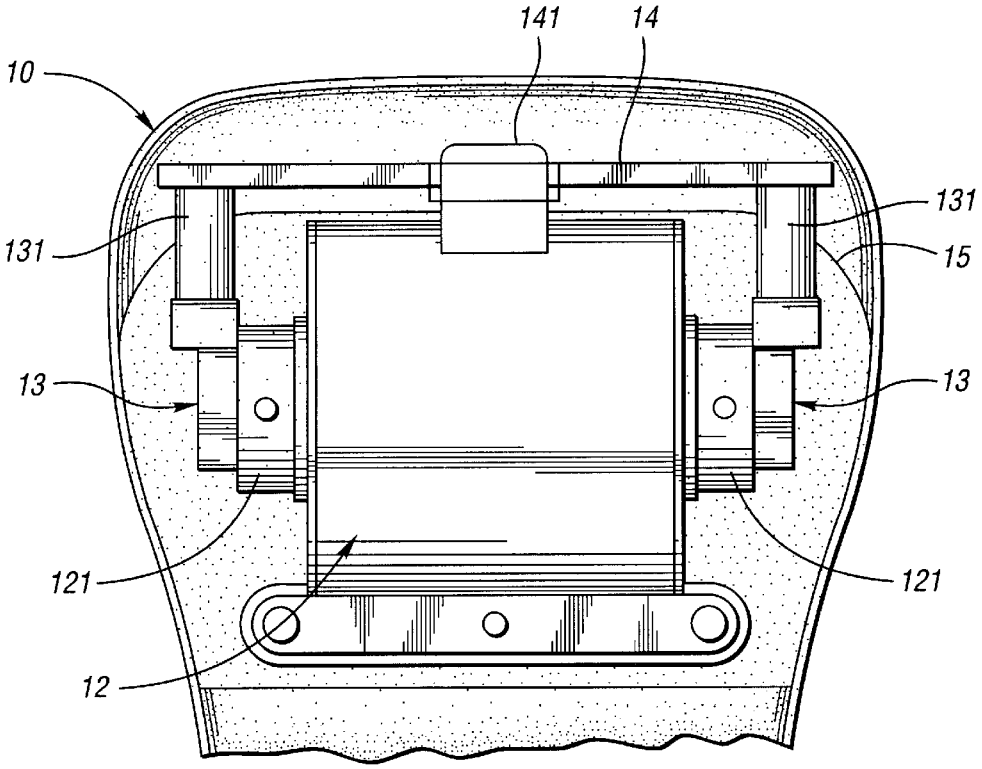
FIG. 3 is a bottom plane view of the transmission device of the massager in FIG. 1.
Figure 4:
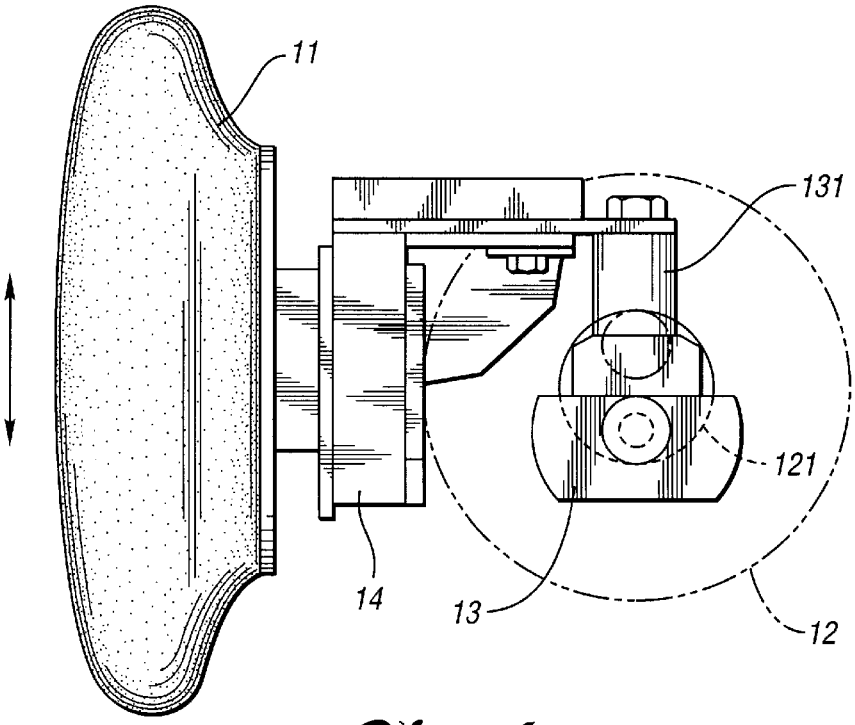
FIG. 4 is an enlarged side plan view of the massager in FIG. 1 showing the structural relationship between the massage node and the transmission device.
Figure 5:
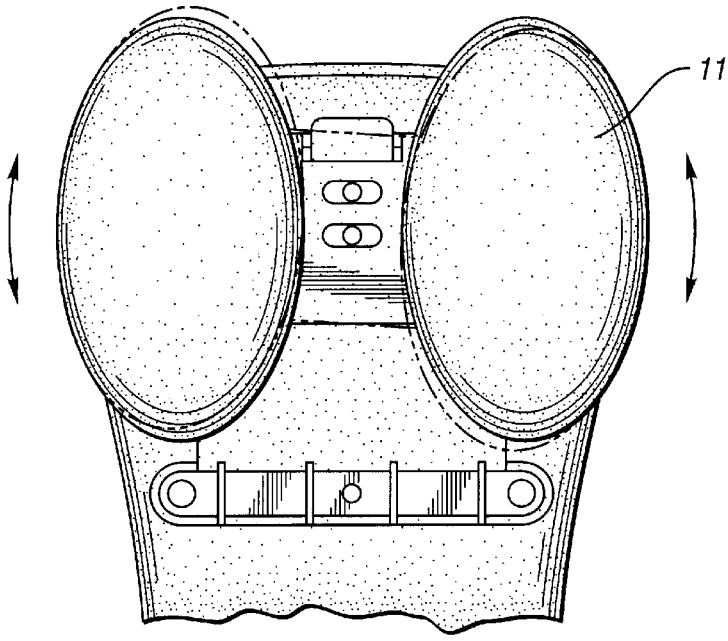
FIG. 5 is an operational front plan view of the massager in FIG. 1 showing the movement of the massage nodes caused by the reciprocating movement of the bridge.
Figure 6:
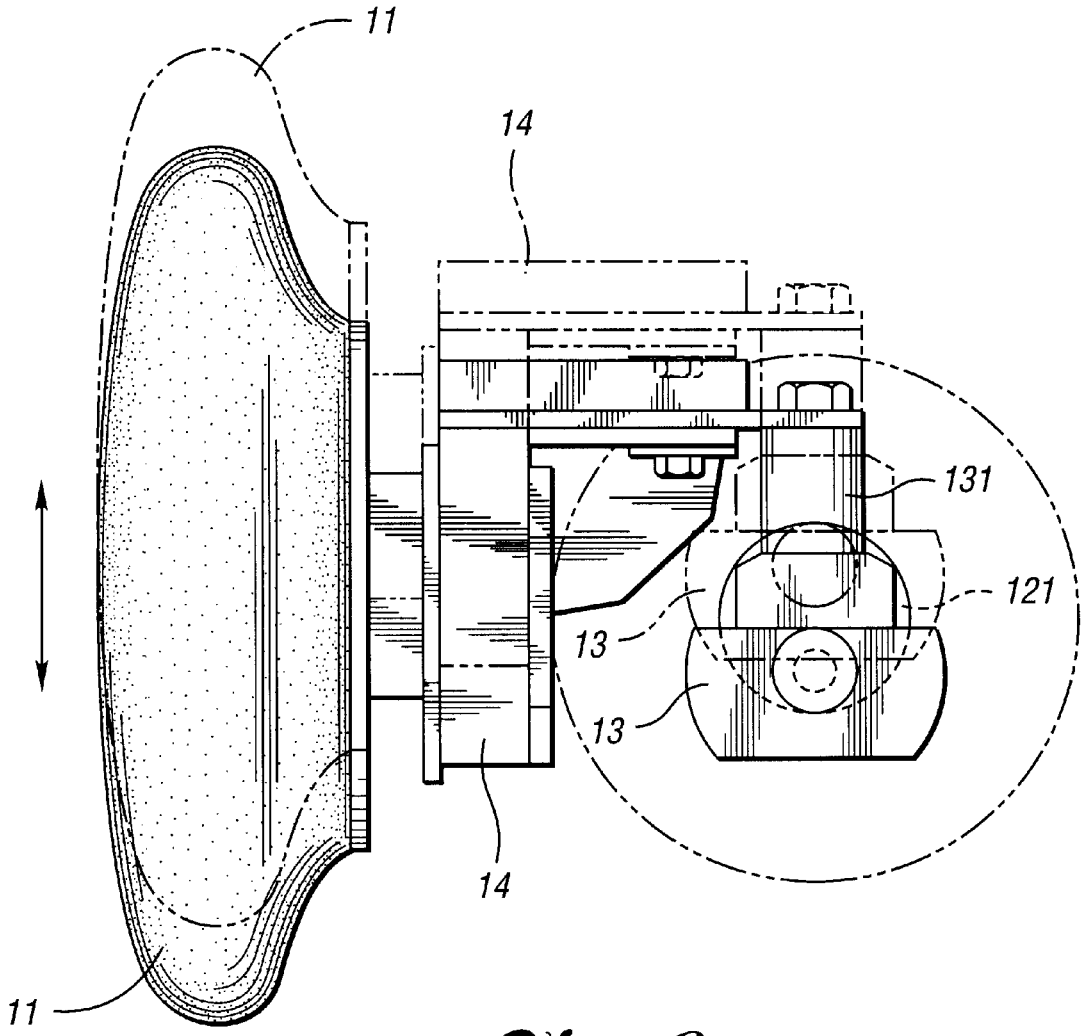
FIG. 6 is an enlarged operational side plan view of the massager in FIG. 1 showing the operation of the bridge, which drives and moves the massage nodes.
Figure 7:
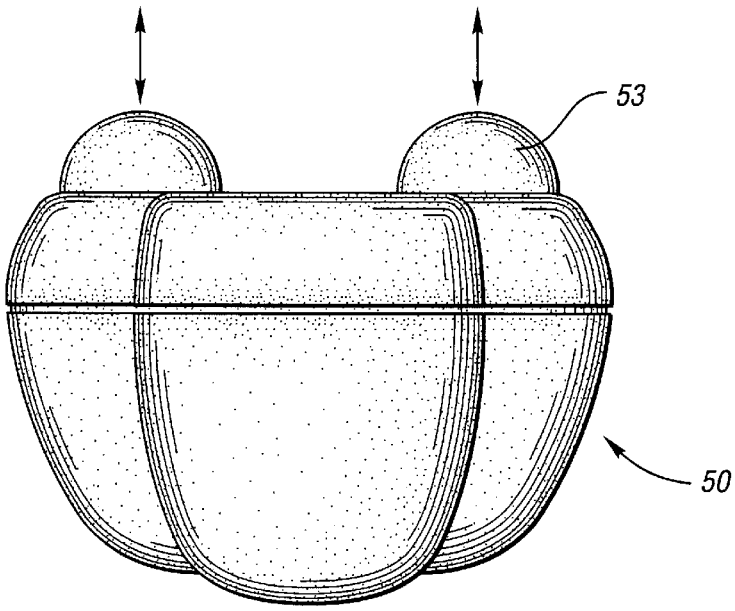
Fig. 7 (PRIOR ART)
FIG. 7 is a top plan view of a conventional massager.
Figure 8:
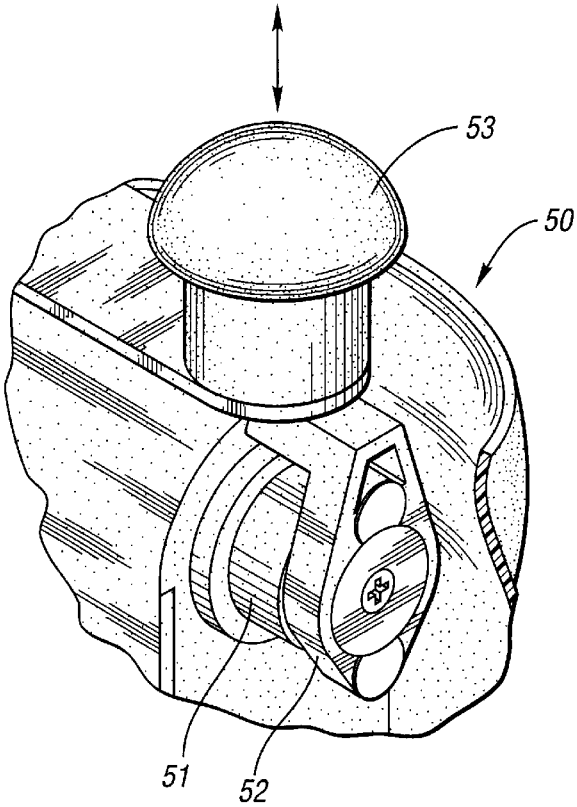
Fig. 8 (PRIOR ART)
FIG. 8 is an enlarged perspective view of the transmission mechanism in the conventional massager, wherein the ball moves up and down due to the eccentric connection between the linkage and the motor shaft.

With reference to FIGS. 5 and 6 and still taking FIG. 3 for reference, when the motor (12) runs, the rotation of the motor shaft (121) drives the linkages (13) on opposite ends of the motor shaft (121) to linearly reciprocate relative to the motor (12). Accordingly, the linear movement of the linkages (13) drives the bridge (14) to pivotally reciprocate about axis "X". Thus the massage nodes (11) mounted on the bridge (14) pivotally reciprocate laterally along with the bridge (14) in a plane parallel to the skin surface "S" of the user being massaged. The lateral movement of the massage nodes heating a rubbing and massage effect on the user's skin.

Figure 2:
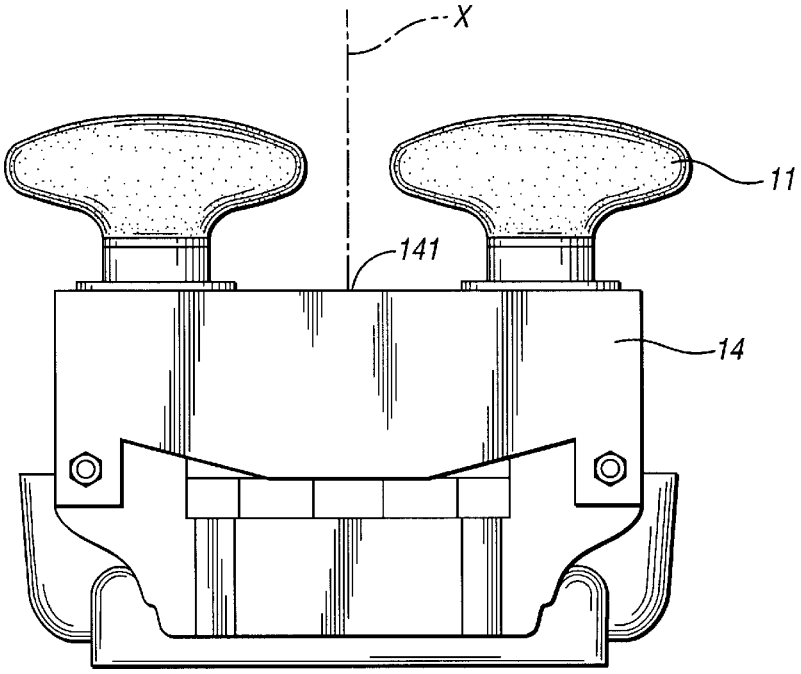
FIG. 2 is a top plan view of the massager in FIG. 1.

The massager nodes being generally oval in shape when viewed along X axis as shown in FIG. 5. The massage nodes having a massage surface for engaging a user which is gradual convexly crowned when viewed laterally to the massage axis X as shown in FIGS. 1 and 2. Furthermore, the massager has a printed circuit board (15) mounted in the housing (10), and the housing (10) has control buttons (101, 102, 103) to respectively turn power on or off, control the speed of motor rotation and initiate or turn off heat generation. Since the control of motor speed, heat generation and power on/off are conventional in the art, further detailed description of these features is omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A massager comprising:

a housing;

a pair of massage modes pivotally movable with respect to the housing in a lateral plane parallel to the skin surface, the massager nodes each having a surface for engaging a user;

a motor securely mounted in the housing and having a motor shaft extending from opposite ends of the motor;

a pair of linkages each eccentrically and rotatably attached to an opposite end of the motor shaft;

a pair of flexible arms each securely attached to one of the linkages; and a bridge pivotally attached to motor and housing about a normal axis perpendicular to the lateral plane, the bridge being securely connected to the pair of flexible arms and having the massage nodes securely and oppositely mounted on the bridge, such that the movement of the motor drives the linkages to reciprocate and move linearly, which consequently causes the massage nodes on the bridge to pivotally reciprocate thereby laterally providing a rubbing massage effect upon the user.

2. The massager as claimed in claim 1, wherein the housing has control buttons operably mounted on the housing for respectively controlling power provision, heat generation and motor rotation speed.

3. A massager of claim 1 wherein the pair of massage nodes are generally oval in shape in front plan view.

4. A massager of claim 3 wherein the pair of massage nodes are each gradually convexly crowned when viewed laterally to the normal axis.

5. A massager of claim 1 wherein the housing is further provided with an elongate handle which extends laterally relative to the normal axis.

6. A massager comprising:

a housing;

a motor affixed to the housing, the motor having at least one rotary output shaft extending therefrom;

an elongate bridge member centrally and pivotally mounted relative to the housing pivoting about a massage axis generally normal to a region of a user to be massaged;

a pair of massage nodes affixed to the bridge member on opposite sides of the massage axis; and at least one eccentric linkage cooperating with the bridge member and the motor output shaft to cause the bridge member to reciprocally oscillate about the massage axis causing the pair of massage nodes to reciprocate laterally in a plane perpendicular to the massage axis providing a rubbing massage effect upon the user.

7. The massager of claim 6 wherein the housing is provided with an enlarged portion in which the motor is affixed and an elongate handle portion extending laterally therefrom generally perpendicular to the massage axis.

8. The massager of claim 6 wherein the pair of massage nodes are each generally oval in shape when viewed along the massage axis.

9. The massager of claim 8 wherein each of the massage nodes has a massage surface for cooperating with the user which is gradually convexly crowned when viewed laterally to the massage axis.

10. The massager of claim 6 wherein the motor having at least one rotary output shaft comprises a pair of rotary output shafts one extending from each axial end of the motor.

11. The massager of claim 10 wherein the at least one eccentric linkage further comprises a pair of eccentric linkages each cooperating with an opposed one of the motor output shafts and the allocated bridge member.

12. A massager comprising:

a housing having a head portion and an elongate handle extending laterally from the head portion;

a motor affixed to and mounted within the head portion of the housing, the motor having two axially spaced apart rotary output shafts extending therefrom;

an elongate bridge member centrally and pivotally mounted relative to the housing pivoting about a massage axis generally normal to a region of a user to be massaged;

a pair of massage nodes affixed to the bridge member on opposite sides of the massage axis; and a pair of eccentric linkages each cooperating with one of the motor rotary output shafts and the allocated bridge member to cause the bridge member to reciprocally oscillate about the massage axis causing the pair of massage nodes to reciprocate laterally in a plane perpendicular to the massage axis providing a rubbing massage effect upon the user.

13. The massager of claim 12 wherein the pair of massage nodes are each generally oval in shape when viewed along the massage axis.

14. The massager of claim 12 wherein each of the massage nodes has a massage surface for cooperating with the user which is gradually convexly crowned when viewed laterally to the massage axis.

15. The massager as claimed in claim 12, wherein the housing has control buttons operably mounted on the housing for respectively controlling power provision, heat generation and motor rotation speed.

* * * * *

UNITED STATES PATENT AND TRADEMARK OFFICE

CERTIFICATE OF CORRECTION

PATENT NO. : 6,730,050 B2
DATED : May 4, 2004
INVENTOR(S) : Chen-Ming Huang

It is certified that error appears in the above-identified patent and that said Letters Patent is hereby corrected as shown below:

Column 3,
Line 4, delete “modes” and insert therefor -- nodes --.

Signed and Sealed this

Twenty-seventh Day of July, 2004

JON W. DUDAS
*Acting Director of the United States Patent and Trademark Office*